US011788390B2

(12) United States Patent
Chen et al.

(10) Patent No.: US 11,788,390 B2
(45) Date of Patent: Oct. 17, 2023

(54) SELF-POWERED DOWNHOLE INJECTION SYSTEMS AND METHODS FOR OPERATING THE SAME

(71) Applicant: Saudi Arabian Oil Company, Dhahran (SA)

(72) Inventors: Tao Chen, Dhahran (SA); Qiwei Wang, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 147 days.

(21) Appl. No.: 17/174,445

(22) Filed: Feb. 12, 2021

(65) Prior Publication Data

US 2022/0259954 A1 Aug. 18, 2022

(51) Int. Cl.

| | |
|---|---|
| ***E21B 43/12*** | (2006.01) |
| ***E21B 33/068*** | (2006.01) |
| ***E21B 34/02*** | (2006.01) |
| ***E21B 47/00*** | (2012.01) |

(52) U.S. Cl.

CPC ..... *E21B 43/12* (2013.01); *E21B 33/068* (2013.01); *E21B 34/02* (2013.01); *E21B 47/00* (2013.01)

(58) Field of Classification Search

CPC ..... E21B 43/12; E21B 33/068; E21B 34/02; E21B 47/00

USPC ..... 166/305.1

See application file for complete search history.

(56) References Cited

U.S. PATENT DOCUMENTS

| | | | | |
|---|---|---|---|---|
| 6,981,553 | B2 | 1/2006 | Stegemeier et al. | |
| 7,870,899 | B2 | 1/2011 | Wilson | |
| 9,169,714 | B2 * | 10/2015 | Edwards | E21B 33/076 |
| 10,480,501 | B2 | 11/2019 | Tolman et al. | |

(Continued)

FOREIGN PATENT DOCUMENTS

| | | | |
|---|---|---|---|
| CN | 2599237 | Y | 1/2004 |
| WO | 2005108743 | A1 | 11/2005 |
| WO | 2006068171 | A1 | 6/2006 |

OTHER PUBLICATIONS

Notification of Transmittal of the International Search Report and the Written Opinion of the International Searching Authority, or the Declaration dated Jul. 1, 2022 pertaining to International application No. PCT/US2022/015458 filed Feb. 7, 2022, pp. 1-18.

(Continued)

*Primary Examiner* — Matthew R Buck
*Assistant Examiner* — Patrick F Lambe
(74) *Attorney, Agent, or Firm* — DINSMORE & SHOHL LLP

(57) ABSTRACT

A downhole injection system in selective communication with a wellhead assembly and a wellbore, the downhole injection system including a pumping chamber in selective communication with the wellhead assembly, the pumping chamber defining a wellhead pressure portion defining a wellhead pressure inlet in selective communication with the wellhead assembly and a wellhead pressure outlet in selective communication with the wellhead assembly, where the wellhead pressure portion is maintained at a wellhead pressure, and a chemical portion in selective communication with the wellbore, and a movable plate positioned within the pumping chamber, where the chemical portion is separated from the wellhead pressure portion by the movable plate.

8 Claims, 2 Drawing Sheets

(56) References Cited

U.S. PATENT DOCUMENTS

| | | | | |
|---|---|---|---|---|
| 2009/0114391 | A1* | 5/2009 | Smith, IV | E21B 37/06 166/305.1 |
| 2014/0318763 | A1* | 10/2014 | Hearn | E21B 43/129 166/105.5 |
| 2018/0216982 | A1* | 8/2018 | Slot, III | E21B 33/068 |
| 2018/0223643 | A1* | 8/2018 | Saponja | E21B 43/12 |
| 2020/0190948 | A1* | 6/2020 | Chitwood | E21B 43/12 |
| 2020/0208497 | A1* | 7/2020 | Vick, Jr. | E21B 43/25 |
| 2021/0172307 | A1* | 6/2021 | Surjaatmadja | E21B 43/26 |

OTHER PUBLICATIONS

Guerra et al., "Designing Downhole Chemical Injection Systems", Society o9f Petroleum Engineers, SPE-170772-MS, Oct. 27-29, 2014.

* cited by examiner

SELF-POWERED DOWNHOLE INJECTION SYSTEMS AND METHODS FOR OPERATING THE SAME

FIELD

The present disclosure relates to self-powered downhole injection systems and methods for operating the same.

TECHNICAL BACKGROUND

During drilling and pumping operations, chemicals can be injected downhole for a variety of reasons, for example, to resist corrosion and/or clear buildup in the wellbore.

BRIEF SUMMARY

Downhole injection systems may include spooling units, pumps, filters, slips, and/or sheaves that are utilized to pump chemicals down the wellbore. The pumps are generally used to drive chemicals into the wellbore, and in some instances, may be electrically powered. In wells at remote locations, installation and/or maintenance of the downhole injection systems may be costly, and electrical power for the downhole injection systems may be unreliable or unavailable. Accordingly, a need exists for improved downhole injection systems that do not require external power sources.

Embodiments of the present disclosure are generally directed to self-powered downhole injection systems that are powered at least in part via pressure from a wellhead assembly. In particular, downhole injection systems according to the present disclosure utilize the pressure of well material (e.g., gases and/or fluids from a wellhead assembly) to pump chemicals down the wellbore. By utilizing the pressure of well material to pump chemicals down the wellbore, chemicals can be driven into the wellbore without requiring external power or electricity.

In one embodiment, a downhole injection system in selective communication with a wellhead assembly and a wellbore, the downhole injection system including a pumping chamber in selective communication with the wellhead assembly, the pumping chamber defining a wellhead pressure portion defining a wellhead pressure inlet in selective communication with the wellhead assembly and a wellhead pressure outlet in selective communication with the wellhead assembly, where the wellhead pressure portion is maintained at a wellhead pressure, and a chemical portion in selective communication with the wellbore, and a movable plate positioned within the pumping chamber, where the chemical portion is separated from the wellhead pressure portion by the movable plate.

In another embodiment, a method for pumping chemicals down a wellbore includes passing a well material including at least one of a fluid or gas from the wellbore to a wellhead assembly in communication with the wellbore, passing at least a portion of the well material to a wellhead pressure portion of a pumping chamber, thereby applying a force on a movable plate positioned within the pumping chamber, where the pumping chamber defines the wellhead pressure portion and a chemical portion separated by the movable plate, applying a pressure on chemicals positioned in the chemical portion of the pumping chamber with the movable plate, and moving the chemicals from the chemical portion of the pumping chamber to the wellbore.

In yet another embodiment, a downhole injection system in selective communication with a wellhead assembly and a wellbore, the downhole injection system including a pumping chamber in selective communication with the wellhead assembly, the pumping chamber defining a wellhead pressure portion defining a wellhead pressure inlet in selective communication with the wellhead assembly and a wellhead pressure outlet in selective communication with the wellhead assembly, where the wellhead pressure portion is maintained at a wellhead pressure, and a chemical portion in selective communication with the wellbore, and a supplemental pump in selective communication with the wellhead pressure portion of the pumping chamber.

Additional features and advantages of the technology disclosed in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments of the present disclosure are generally directed to self-powered downhole injection systems that are powered at least in part via pressure from a wellhead assembly. In particular, downhole injection systems according to the present disclosure utilize the pressure of well material (e.g., gases and/or fluids from a wellhead assembly) to pump chemicals down a wellbore. By utilizing the pressure of well material to pump chemicals down the wellbore, chemicals can be driven into the wellbore without requiring external power or electricity. These and other embodiments will now be described with reference to the appended drawings.

Figure 1:
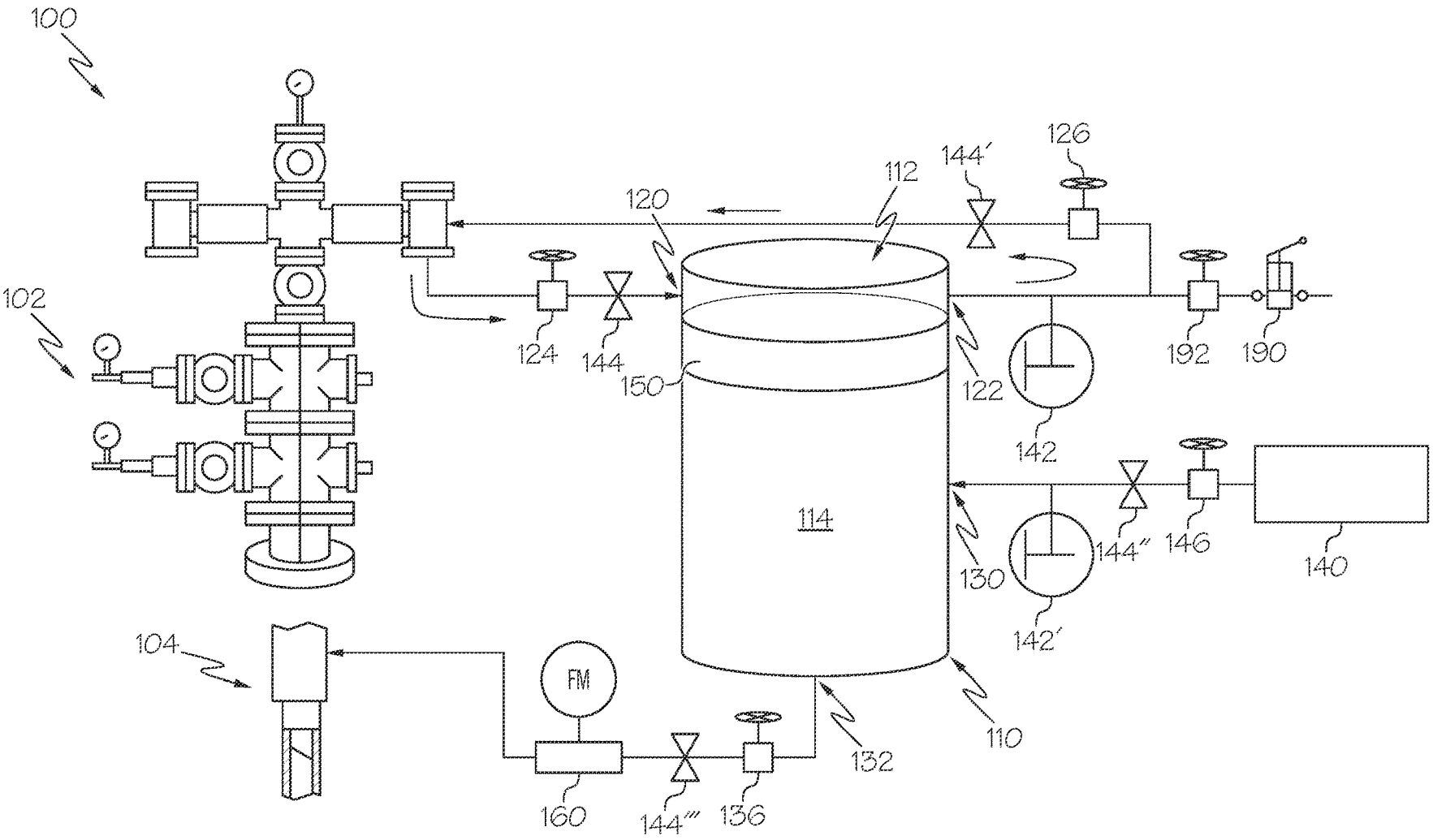
FIG. 1 schematically depicts a downhole injection system, according to one or more embodiments shown and described herein.

Referring initially to FIG. 1, a downhole injection system 100 is schematically depicted. In embodiments, the downhole injection system 100 includes a pumping chamber 110 in selective communication with a wellhead assembly 102 and a wellbore 104. The wellbore 104 generally includes a subterranean hole, and in production, fluids and/or gases (e.g., oil and/or gas) flow from the wellbore 104 to the wellhead assembly 102. For example, fluids and/or gases (e.g., oil and/or gas) may flow from ground surrounding the wellbore 104 to the wellbore 104, and may flow through the wellbore 104 to the wellhead assembly 102. While in the view depicted in FIG. 1 the wellbore 104 is shown as having a generally vertical orientation, is should be understood that this is merely an example. For example, in some embodiments, portions of the wellbore 104 may extend at least partially in a horizontal direction. The wellhead assembly 102, in embodiments, is generally positioned above the wellbore 104 and provides one or more pressure seals and one or more suspension points for strings (e.g., casing strings, drill strings, and/or the like) that run through the wellbore 104.

In embodiments, the pumping chamber 110 defines a wellhead pressure portion 112 in selective communication with the wellhead assembly 102, and a chemical portion 114 in selective communication with the wellbore 104. In embodiments, a movable plate 150 is positioned within the pumping chamber 110 and separates the chemical portion 114 from the wellhead pressure portion 112. In some embodiments, the movable plate 150 at least partially defines the wellhead pressure portion 112 and the chemical portion 114. For example, in some embodiments, the wellhead pressure portion 112 is at least partially defined by one or more sidewalls of the pumping chamber 110 and the movable plate 150. Similarly, in some embodiments, the chemical portion 114 is at least partially defined by one or more sidewalls of the pumping chamber 110 and the movable plate 150. In some embodiments, the movable plate 150 may generally seal the chemical portion 114 from the wellhead pressure portion 112.

In embodiments, the movable plate 150 is movable within the pumping chamber 110. For example, the movable plate 150 may move within the pumping chamber 110 toward the wellhead pressure portion 112, thereby reducing a volume of the wellhead pressure portion 112. In other words, as the movable plate 150 moves within the pumping chamber 110 toward the wellhead pressure portion 112, the wellhead pressure portion 112 is compressed. As the movable plate 150 moves within the pumping chamber toward the wellhead pressure portion 112, the movable plate 150 moves away from the chemical portion 114, thereby expanding a volume of the chemical portion 114. In other words, as the wellhead pressure portion 112 is compressed, the movable plate 150 expands the chemical portion 114 of the pumping chamber 110.

Conversely, the movable plate 150 may move within the pumping chamber 110 away from the wellhead pressure portion 112, thereby increasing the volume of the wellhead pressure portion 112. In other words, as the movable plate 150 moves away from the wellhead pressure portion 112, the wellhead pressure portion 112 expands. As the movable plate 150 moves within the pumping chamber 110 away from the wellhead pressure portion 112, the movable plate 150 moves toward the chemical portion 114, thereby reducing the volume of the chemical portion 114. In other words, as the movable plate 150 moves away from the wellhead pressure portion 112, the movable plate 150 compresses the chemical portion 114 of the pumping chamber 110. By expanding or compressing the chemical portion 114, the movable plate 150 may be used to pump chemicals to the wellbore 104, as described in greater detail herein.

In some embodiments, the wellhead pressure portion 112 defines a wellhead pressure inlet 120 in selective communication with the wellhead assembly 102, and a wellhead pressure outlet 122 in selective communication with the wellhead assembly 102. Wellhead material (e.g., oil and/or gas) may flow from the wellhead assembly 102 into the wellhead pressure portion 112 of the pumping chamber 110 through the wellhead pressure inlet 120. In embodiments, wellhead material (e.g., oil and/or gas) may flow from the wellhead pressure portion 112 of the pumping chamber 110 back to the wellhead assembly 102 through the wellhead pressure outlet 122.

In some embodiments, the downhole injection system 100 further includes a wellhead pressure inlet valve 124 positioned between the wellhead assembly 102 and the wellhead pressure portion 112 of the pumping chamber 110. The wellhead pressure inlet valve 124, in embodiments, is positionable between an open position and a closed position. In the open position, wellhead material (e.g., oil and/or gas) can flow from the wellhead assembly 102 to the wellhead pressure portion 112 of the pumping chamber 110 through the wellhead pressure inlet valve 124. In the closed position, the wellhead material (e.g., oil and/or gas) is restricted from flowing from the wellhead assembly 102 to the wellhead pressure portion 112 of the pumping chamber 110 through the wellhead pressure inlet valve 124.

In some embodiments, the downhole injection system 100 further includes a wellhead pressure outlet valve 126 positioned between the wellhead pressure portion 112 of the pumping chamber 110 and the wellhead assembly 102. In embodiments, the wellhead pressure outlet valve 126 is positionable between an open position and a closed position. In the open position, wellhead material (e.g., oil and/or gas) can flow from the wellhead pressure portion 112 of the pumping chamber 110 to the wellhead assembly 102 through the wellhead pressure outlet valve 126. In the closed position, wellhead material is restricted from flowing from the wellhead pressure portion 112 of the pumping chamber 110 to the wellhead assembly 102 through the wellhead pressure outlet valve 126.

Accordingly, through selectively opening and closing the wellhead pressure inlet valve 124 and the wellhead pressure outlet valve 126, wellhead material (e.g., oil and/or gas) can flow from the wellhead assembly 102 to the wellhead pressure portion 112 of the pumping chamber 110, and may return from the wellhead pressure portion 112 to the wellhead assembly 102. By passing wellhead material (e.g., oil and/or gas) from the wellhead assembly 102 to the wellhead pressure portion 112 of the pumping chamber 110, the wellhead pressure portion 112 of the pumping chamber 110 may be maintained at a pressure similar to the pressure of wellhead material at the wellhead assembly 102. By maintaining the pressure of the wellhead pressure portion 112 at a pressure similar to the pressure of wellhead material at the wellhead assembly 102, the wellhead material within the wellhead pressure portion 112 may apply a force to the movable plate 150, biasing the movable plate 150 away from the wellhead pressure portion 112. By biasing the movable plate 150 away from the wellhead pressure portion 112, the movable plate 150 may apply pressure to the chemical portion 114 of the pumping chamber 110 to pump chemicals from the chemical portion 114 down the wellbore 104, as described in greater detail herein. While the wellhead pressure inlet valve 124 and the wellhead pressure outlet valve 126 are described as being positionable between an open and a closed position, it should be understood that in some embodiments, the wellhead pressure inlet valve 124 and/or the wellhead pressure outlet valve 126 may be positionable at varying positions between the open position and the closed position. For example, in some embodiments, the wellhead pressure inlet valve 124 and/or the wellhead pressure outlet valve 126 may be partially opened and/or partially closed, and can selectively control the flow rate of wellhead material (e.g., oil and/or gas) to and from the wellhead assembly 102 to the wellhead pressure portion 112.

In some embodiments, the downhole injection system 100 includes a supplemental pump 190 in selective communication with the wellhead pressure portion 112 of the pumping chamber 110. The supplemental pump 190 may generally pass fluid to the wellhead pressure portion 112 of the pumping chamber 110. For example in circumstances in which the wellhead pressure portion 112 is not connected to the wellhead assembly 102 (e.g., with the wellhead pressure inlet valve 124 and/or the wellhead pressure outlet valve 126 in the closed position), the supplemental pump 190 may pass fluid to the wellhead pressure portion 112, as described in greater detail herein.

In the embodiment depicted in FIG. 1, the downhole injection system 100 includes a supplemental pump valve 192 positioned between the supplemental pump 190 and the wellhead pressure portion 112 of the pumping chamber 110. In embodiments, the supplemental pump valve 192 is positionable between an open position. In the open position, fluid from the supplemental pump 190 can pass to the wellhead pressure portion 112 through the supplemental pump valve 192. In the closed position, fluid from the supplemental pump 190 is restricted from flowing to the wellhead pressure portion 112 through the supplemental pump valve 192. With the supplemental pump valve 192 in the closed position, wellhead material (e.g., fluid and/or gas) from the wellhead assembly 102 (via the wellhead pressure portion 112 of the pumping chamber 110) may be restricted from flowing to the supplemental pump 190.

In embodiments, the chemical portion 114 defines a chemical portion inlet 130 and a chemical portion outlet 132. The chemical portion inlet 130, in embodiments, is in selective communication with a chemical source 140. The chemical source 140 may be a reservoir or the like that provides chemicals, such as scale and corrosion inhibitors, foamers, biocides, wax and asphaltene inhibitors and solvents, and/or the like, to the chemical portion 114 of the pumping chamber 110. The chemical portion outlet 132, in some embodiments, is in selective communication with the wellbore 104. In some embodiments, chemicals may pass to the chemical portion 114 through the chemical portion inlet 130, and chemicals may pass from the chemical portion 114 to the wellbore 104 through the chemical portion outlet 132.

In some embodiments, the downhole injection system 100 includes a chemical portion inlet valve 134 positioned between the chemical portion 114 of the pumping chamber 110 and the chemical source 140. In embodiments, the chemical portion inlet valve 134 is positionable between an open position and a closed position. In the open position, chemicals can flow from the chemical source 140 to the chemical portion 114 of the pumping chamber 110 through the chemical portion inlet valve 134. In the closed position, chemicals are restricted from flowing from the chemical source 140 to the chemical portion 114 of the pumping chamber 110 through the chemical portion inlet valve 134.

In some embodiments, the downhole injection system 100 further includes a chemical portion outlet valve 136 positioned between the chemical portion outlet 132 and the wellbore 104. The chemical portion outlet valve 136, in embodiments, is positionable between an open position and a closed position. In the open position, chemicals from the chemical portion 114 of the pumping chamber 110 can flow to the wellbore 104 through the chemical portion outlet valve 136. In the closed position, chemicals from the chemical portion 114 of the pumping chamber 110 are restricted from flowing to the wellbore 104 through the chemical portion outlet valve 136. While the chemical portion inlet valve 134 and the chemical portion outlet valve 136 are described as being positionable between an open and a closed position, it should be understood that in some embodiments, the chemical portion inlet valve 134 and/or the chemical portion outlet valve 136 may be positionable at varying positions between the open position and the closed position. For example, in some embodiments, the chemical portion inlet valve 134 and/or the chemical portion outlet valve 136 may be partially opened and/or partially closed, and can selectively control the flow rate of chemicals to the chemical portion 114 of the pumping chamber 110 and from the chemical portion 114 of the pumping chamber 110 to the wellbore 104.

In some embodiments, the downhole injection system 100 includes a flow detection device 160 positioned between the chemical portion outlet 132 and the wellbore 104, where the flow detection device 160 is structurally configured to detect the flow of chemicals from the chemical portion 114 of the pumping chamber 110 to the wellbore 104. The flow detection device 160 may include, for example and without limitation, a flowmeter or the like.

In some embodiments, the downhole injection system 100 includes one or more pressure relief valves 142, 142' in communication with at least one of the wellhead pressure portion 112 of the pumping chamber 110 and the chemical portion 114 of the pumping chamber 110. For example, in the embodiment depicted in FIG. 1, the downhole injection system 100 includes one or more wellhead pressure relief valves 142 in communication with the wellhead pressure portion 112 of the pumping chamber 110, and one or more chemical pressure relief valves 142' are in communication with the chemical portion 114 of the pumping chamber 110. The pressure relief valves 142, 142', in embodiments, are positionable between an open position and a closed position. With the one or more wellhead pressure relief valves 142 in the open position, wellhead material may flow from the wellhead pressure portion 112 of the pumping chamber 110 through the one or more wellhead pressure relief valves 142. Likewise, with the one or more chemical pressure relief valves 142' in the open position, chemicals may flow from the chemical portion 114 of the pumping chamber 110 through the one or more chemical pressure relief valves 142'.

By contrast, with the one or more wellhead pressure relief valves 142 in the closed position, wellhead material is restricted from flowing from the wellhead pressure portion 112 of the pumping chamber 110 through the one or more wellhead pressure relief valves 142. Similarly, with the one or more chemical pressure relief valves 142' in the closed position, chemicals are restricted from flowing from the chemical portion 114 of the pumping chamber 110 through the one or more pressure relief valves 142'.

In embodiments, the one or more wellhead pressure relief valves 142 are movable from the closed position to the open position based at least in part on the pressure of wellhead material within the wellhead pressure portion 112 of the pumping chamber 110. For example, in some embodiments, the one or more wellhead pressure relief valves 142 are structurally configured to move from the closed position to the open position in response to the pressure of wellhead material within the wellhead pressure portion 112 of the pumping chamber 110 exceeding a predetermined threshold pressure. By moving from the closed position to the open position, the one or more wellhead pressure relief valves 142 may relieve the pressure of wellhead pressure in the wellhead pressure portion 112, thereby maintaining wellhead material within the wellhead pressure portion 112 within the predetermined threshold pressure. By maintaining wellhead material within the wellhead pressure portion 112 of the pumping chamber 110 within the predetermined threshold pressure, the one or more wellhead pressure relief valves 142 may assist in preventing undesirably high pressures within the wellhead pressure portion 112. In some embodiments, the one or more wellhead pressure relief valves 142 can be moved from the closed position to the open position manually or through one or more devices structurally configured to move the one or more wellhead pressure relief valves 142 from the closed position to the open position.

Likewise, in embodiments, the one or more chemical pressure relief valves 142' are movable from the closed position to the open position based at least in part on the pressure of chemicals within the chemical portion 114 of the pumping chamber 110. For example, in some embodiments, the one or more chemical pressure relief valves 142' are structurally configured to move from the closed position to the open position in response to the pressure of chemicals within the chemical portion 114 of the pumping chamber 110 exceeding a predetermined threshold pressure. By moving from the closed position to the open position, the one or more chemical pressure relief valves 142' may relieve the pressure of chemicals within the chemical portion 114, thereby maintaining chemicals within the chemical portion 114 within the predetermined threshold pressure. By maintaining chemicals within the chemical portion 114 of the pumping chamber 110 within the predetermined threshold pressure, the one or more chemical pressure relief valves 142' may assist in preventing undesirably high pressures within the chemical portion 114. In some embodiments, the one or more chemical pressure relief valves 142' can be moved from the closed position to the open position manually or through one or more devices structurally configured to move the one or more chemical pressure relief valves 142' from the closed position to the open position.

In some embodiments, the downhole injection system 100 includes one or more check valves 144, 144', 144", 144'". For example, in the embodiment depicted in FIG. 1, the downhole injection system 100 includes a wellhead inlet check valve 144, a wellhead outlet check valve 144', a chemical inlet check valve 144", and a chemical outlet check valve 144'. The one or more check valves 144, 144', 144", 144'", in embodiments, may allow gases and/or fluids to flow in one direction, but may restrict the gases and/or fluids from flowing in another direction. For example, in embodiments, the wellhead inlet check valve 144 allows wellhead material (e.g., oil and/or gas) to flow from the wellhead assembly 102 to the wellhead pressure portion 112 of the pumping chamber 110 through the wellhead inlet check valve 144, while restricting the flow of wellhead material from the wellhead pressure portion 112 to the wellhead assembly 102 through the wellhead inlet check valve 144. The wellhead outlet check valve 144' allows wellhead material to flow from the wellhead pressure portion 112 of the pumping chamber 110 to the wellhead assembly 102 through the wellhead outlet check valve 144', while restricting the flow of wellhead material from the wellhead assembly 102 to the wellhead pressure portion 112 through the wellhead outlet check valve 144'. Accordingly the wellhead inlet check valve 144 and the wellhead outlet check valve 144' may assist in routing wellhead material (e.g., oil and/or gas) from the wellhead assembly 102, through the wellhead pressure inlet 120 to the wellhead pressure portion 112 of the pumping chamber 110, and out the wellhead pressure outlet 122 back to the wellhead assembly 102.

In embodiments, the chemical inlet check valve 144" allows chemicals to flow from the chemical source 140 to the chemical portion 114 of the pumping chamber 110 through the chemical inlet check valve 144", while restricting the flow of chemicals from the chemical portion 114 back to the chemical source 140 through the chemical inlet check valve 144". The chemical outlet check valve 144'" allows chemicals to flow from the chemical portion 114 of the pumping chamber 110 to the wellbore 104 through the chemical outlet check valve 144'", while restricting the flow of chemicals from the wellbore 104 to the chemical portion 114 through the chemical outlet check valve 144'". Accordingly, the chemical inlet check valve 144" and the chemical outlet check valve 144'" may direct chemicals from the chemical source 140 to the chemical portion 114 to the pumping chamber 110, and from the chemical portion 114 of the pumping chamber 110 to the wellbore 104.

Figure 2:
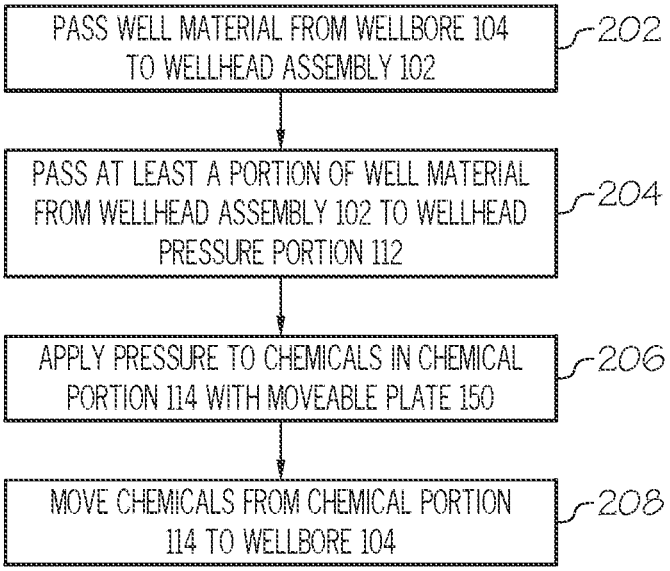
FIG. 2 depicts a flowchart of an example method for operating the downhole injection system of FIG. 1, according to one or more embodiments shown and described herein.

Referring to FIGS. 1 and 2, a flowchart of an exemplary method for pumping a chemical down the wellbore 104 is depicted. In a first block 202, well material (e.g., oil and/or gas) is passed from the wellbore 104 to the wellhead assembly 102. As discussed above, oil and/or gas from ground surrounding the wellbore 104 may flow to the wellbore 104. The well material (e.g., oil and/or gas) may then pass through the wellbore 104 to the wellhead assembly 102.

At block 204, at least a portion of the well material is passed to the wellhead pressure portion 112 of the pumping chamber 110. For example, at least a portion of the well material (e.g., wellhead material) may be passed from the wellhead assembly 102 to the wellhead pressure portion 112 of the pumping chamber 110. As discussed above, in some embodiments, passing wellhead material from the wellhead assembly 102 to the wellhead pressure portion 112 of the pumping chamber 110 includes moving the wellhead pressure inlet valve 124 from the closed position to the open position.

The wellhead material, in some embodiments, can be passed from the wellhead assembly 102 to the wellhead pressure portion 112 of the pumping chamber 110, and from the wellhead pressure portion 112 back to the wellhead assembly 102. As discussed above, in some embodiments, passing wellhead material from the wellhead pressure portion 112 of the pumping chamber 110 to the wellhead assembly 102 comprises moving the wellhead pressure outlet valve 126 from the closed position to the open position.

The well material (i.e., the wellhead material) within the wellhead pressure portion 112 applies a force on the movable plate 150 positioned within the pumping chamber 110. For example, as discussed above, wellhead material within the wellhead pressure portion 112, in embodiments, is at a similar pressure as wellhead material at the wellhead assembly 102, and applies the force on the movable plate 150, driving the movable plate 150 away from the wellhead pressure portion 112 to compress the chemical portion 114 of the pumping chamber 110.

In some embodiments, prior to passing the at least a portion of the well material (e.g., the wellbore material) to the wellhead pressure portion 112 of the pumping chamber 110 (e.g., prior to block 204), fluid may be pumped to the wellhead pressure portion 112 of the pumping chamber 110 with the supplemental pump 190. For example in some embodiments, at startup or in the instance that the pressure of wellhead material from the wellhead assembly 102 is insufficient, fluid can be pumped from the supplemental pump 190 to the wellhead pressure portion 112 to apply force to the movable plate 150 and pump chemicals from the chemical portion 114 to the wellbore 104. For example, the wellhead pressure inlet valve 124 and the wellhead pressure outlet valve 126 may be moved to the closed position, such that fluid pumped from the supplemental pump 190 may be retained in the wellhead pressure portion 112 and apply force to the movable plate 150.

At block 206, pressure is applied to chemicals within the chemical portion 114 of the pumping chamber 110 by the movable plate 150. At block 208, the chemicals are moved from the chemical portion 114 to the wellbore 104. For example, the pressure applied to the chemicals within the chemical portion 114 by the movable plate 150 may drive the chemicals down the wellbore 104.

As discussed above, in some embodiments, the downhole injection system 100 includes the flow detection device 160, which may detect a flow rate of the chemicals passing from the chemical portion 114 of the pumping chamber 110 to the wellbore 104. In some embodiments, if the detected flowrate of chemicals from the chemical portion 114 of the pumping chamber 110 to the wellbore 104 is less than a configurable threshold, at least one of the pressure of wellhead material within the wellhead pressure portion 112 is increased, or the amount of chemicals within the chemical portion 114 are increased.

For example, in some embodiments, pressure within the wellhead pressure portion 112 may be increased or decreased to increase or decrease the force applied to the movable plate 150 by wellhead material within the wellhead pressure portion 112. Increasing or decreasing the force applied to the movable plate 150 may increase or decrease the pressure of chemicals within the chemical portion 114 of the pumping chamber 110. By increasing or decreasing the pressure of chemicals within the chemical portion 114, the flowrate of chemicals from the chemical portion 114 of the pumping chamber 110 to the wellbore 104 may be increased or decreased. As discussed above, the pressure of wellhead material within the wellhead pressure portion 112 can be selectively increased or decreased, for example through the wellhead pressure inlet valve 124 and/or the wellhead pressure outlet valve 126, and/or via the supplemental pump 190. In some embodiments, the amount of chemicals within the chemical portion 114 may be increased by providing additional chemicals from the chemical source 140, which may assist in increasing the flowrate of chemicals from the chemical portion 114 of the pumping chamber 110 to the wellbore 104.

Accordingly, it should now be understood that embodiments of the present disclosure are generally directed to self-powered downhole injection systems that are powered at least in part via pressure from a wellhead assembly. In particular, downhole injection systems according to the present disclosure utilize the pressure of well material (e.g., gases and/or fluids from wellhead assembly) to pump chemicals down a wellbore. By utilizing the pressure of well material to pump chemicals down the wellbore, chemicals can be driven into the wellbore without requiring external power or electricity.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modifications and variations come within the scope of the appended claims and their equivalents.

It is noted that recitations herein of a component of the present disclosure being "structurally configured" in a particular way, to embody a particular property, or to function in a particular manner, are structural recitations, as opposed to recitations of intended use. More specifically, the references herein to the manner in which a component is "structurally configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A method for pumping chemicals down a wellbore, the method comprising:

passing a well material comprising at least one of a fluid or gas from the wellbore at a well material pressure to a wellhead assembly in communication with the wellbore, wherein the well material is material extracted from a subterranean hole through the wellbore;

maintaining a wellhead pressure portion of the wellhead assembly at a wellhead pressure equal to the well material pressure by passing at least a portion of the well material to the wellhead pressure portion of a pumping chamber through a wellhead pressure inlet valve positioned between the wellhead assembly and the wellhead pressure portion, wherein the wellhead pressure inlet valve is operable between a closed position and an open position, so as to control the portion of the well material passed from the wellhead assembly to the wellhead pressure portion, thereby applying a force on a movable plate positioned within the pumping chamber, wherein the pumping chamber defines the wellhead pressure portion and a chemical portion separated by the movable plate;

applying a pressure on chemicals positioned in the chemical portion of the pumping chamber with the movable plate; and moving the chemicals from the chemical portion of the pumping chamber to the wellbore.

2. The method of claim 1, further comprising passing the at least the portion of the well material from the wellhead pressure portion of the pumping chamber to the wellhead assembly.

3. The method of claim 2, wherein passing the at least the portion of the well material from the wellhead pressure portion of the pumping chamber to the wellhead assembly comprises moving a wellhead pressure outlet valve positioned between the wellhead assembly and the wellhead pressure portion from a closed position to an open position.

4. The method of claim 1, further comprising detecting a flow rate of the chemicals from the chemical portion to the wellbore.

5. The method of claim 4, further comprising:

determining whether the detected flow rate of the chemicals from the chemical portion to the wellbore is less than a configurable threshold; and at least one of increasing a pressure within the wellhead pressure portion or increasing an amount of the chemicals within the chemical portion.

6. The method of claim 4, further comprising increasing a pressure within the wellhead pressure portion of the pumping chamber with a supplemental pump in communication with the wellhead pressure portion of the pumping chamber.

7. The method of claim 1, further comprising, prior to passing the at least the portion of the well material to the wellhead pressure portion of the pumping chamber, pumping a fluid to the wellhead pressure portion of the pumping chamber with a supplemental pump.

8. The method of claim 7, further comprising, prior to pumping the fluid to the wellhead pressure portion of the pumping chamber, moving a wellhead pressure inlet valve positioned between the wellhead assembly and the wellhead pressure portion to a closed position and moving a wellhead pressure outlet valve positioned between the wellhead assembly and the wellhead pressure portion to a closed position.

* * * * *